US009486891B2

(12) United States Patent
Li

(10) Patent No.: US 9,486,891 B2
(45) Date of Patent: Nov. 8, 2016

(54) METHOD FOR POLISHING SPECIAL-SHAPED FACE OF MARBLE

(71) Applicant: GAOYAO CITY DONGYING STONEMASONRY CO., LTD., Guangdong (CN)

(72) Inventor: Ying Li, Zhaoqing (CN)

( * ) Notice: Subject to any disclaimer, the term of this patent is extended or adjusted under 35 U.S.C. 154(b) by 0 days.

(21) Appl. No.: 14/408,551

(22) PCT Filed: May 22, 2013

(86) PCT No.: PCT/CN2013/076027
§ 371 (c)(1),
(2) Date: Dec. 16, 2014

(87) PCT Pub. No.: WO2014/005469
PCT Pub. Date: Jan. 9, 2014

(65) Prior Publication Data

US 2015/0290763 A1 Oct. 15, 2015

(30) Foreign Application Priority Data

Jul. 4, 2012 (CN) ..... 2012 1 0230943

(51) Int. Cl.
*B24B 31/00* (2006.01)
*B24B 31/06* (2006.01)
*B24B 1/00* (2006.01)

(52) U.S. Cl.
CPC *B24B 31/06* (2013.01); *B24B 1/00* (2013.01)

(58) Field of Classification Search
CPC ..... B24B 31/00; B24B 31/02; B24B 31/06; B24B 31/14; B24B 31/073
USPC ..... 451/34–40
See application file for complete search history.

(56) References Cited

U.S. PATENT DOCUMENTS 2,439,156 A * 4/1948 Castle ..... B24B 31/14 427/242
2,464,486 A * 3/1949 Castle ..... B24B 31/14 451/34
3,684,466 A * 8/1972 Petrone ..... B24B 31/14 51/298
3,878,030 A * 4/1975 Cook ..... B44C 5/043 156/71
4,081,929 A * 4/1978 Jones ..... B24B 31/073 451/327

(Continued)

FOREIGN PATENT DOCUMENTS

CN 200710080180 8/2008
CN 201210230943 11/2012
WO WO 9527590 A1 * 10/1995 ..... B24B 1/007

*Primary Examiner* — George Nguyen
(74) *Attorney, Agent, or Firm* — Lowe Graham Jones PLLC

(57) ABSTRACT

A method for polishing a special-shaped face of marble where a marble blank is placed into a vibration grinding machine and subjected to rough and fine grinding by adding thereto abrasive materials to obtain stone with an optimum polished effect. The method breaks the single mirror plane effect of conventional marble, can obtain polished faces of marble having various artistic visual effects and achieves the mechanical polishing of marble stone with improved polishing efficiency and greatly reduced costs of special-shaped marble stone. The method has a polishing cost of only a few tenths of a conventional method, can greatly reduce the cost of a product of special-shaped marble stone, so that the special-shaped polished stone product would possibly become a building material product which can be popularized, enriching the forms of appearance of special-shaped marble stone products and building decorating marble stone.

17 Claims, 3 Drawing Sheets

(56) References Cited

U.S. PATENT DOCUMENTS 4,231,196 A * 11/1980 Jones ..... B24B 31/073 451/32
4,898,598 A 2/1990 Zapata
4,900,409 A * 2/1990 Vunderink ..... B24B 31/00 205/657
5,951,369 A * 9/1999 Kordonski ..... B24B 1/005 451/36
8,662,960 B2 * 3/2014 Inatani ..... B24B 31/064 451/34
2002/0077033 A1 * 6/2002 Yajima ..... B24B 1/00 451/34
2009/0235526 A1 * 9/2009 Secherling ..... B24B 31/02 29/889.7
2010/0003904 A1 * 1/2010 Duescher ..... B24B 37/14 451/259
2010/0210183 A1 * 8/2010 Vincent ..... A63B 53/047 451/34
2015/0290763 A1 * 10/2015 Ying ..... B24B 31/06 451/34

* cited by examiner

METHOD FOR POLISHING SPECIAL-SHAPED FACE OF MARBLE

PRIORITY CLAIM

This application claims priority to PCT Application Serial No. PCT/CN13/076027 filed on May 22, 2013 which claims priority to Chinese Application Serial No. 201210230943.4 filed Jul. 4, 2012, which are hereby incorporated by reference.

FIELD OF THE INVENTION

The present invention relates to a processing technique for building materials, artworks and living things, in particular to a mechanical polishing method for marble stones, particularly special-shaped marble stones.

BACKGROUND OF THE INVENTION

A marble stone is a high-grade building material with its unique texture, nobleness and elegance. The marble stone is also widely used in production or various artworks.

The marbles may be divided into a natural marble and an artificial marble, both having calcium carbonate as the main component, which is susceptible to corrosion by acidic materials, is soft in texture and highly susceptible to fragmentation under excessive pressure. Therefore, the marble stone, especially one with a special-shaped face, is hard to polish for desirable effects.

In the existing mechanical polishing process of building materials and artworks of marble stone whether utilizing a handheld polisher, a small round grinder, a hand grinder, an automatic grinding machine or a line grinding machine and the like, these machines and tools exert pressure and rotate at a high speed on the surface of the marble stone, and water is added to lower the temperature, then the surface of the marble stone is polished by the frictional force between an abrasive material and the marble stone. During polishing, coarse-to-fine and gradually smooth grinding marks on the surface of the marble stone are realized by gradually reducing granularity of the abrasive material so as to meet specific requirements.

There exist two main polishing principles, a particle grinding principle and a physical chemistry principle. According to the first principle, when polishing, the abrasive material grinds on the surface of the marble stone, and grinding marks become finer and finer until indistinguishable by naked eyes, that is, a mirror effect appears. According to the second principle, the polishing process is adjusted for humidity and temperature and enhanced so as to permit physical and chemical reactions to take place on the surface of the marble stone, thereby allowing a gradual increase in surface gloss of the marble stone.

A traditional rotation grinding and polishing method can be effectively applied to the polishing of plane marble stone, but is ineffective in handling special-shaped marble stones such as marble stones with solid geometric faces like convex-concave surfaces, small arc surfaces, reliefs, etc.

The existing polishing of special-shaped marble stones such as mosaic, background wall marble stones having various geometric special-shaped faces, inserts marble stones with relief patterns, relief stone line marble stones, marble stones with carve patterns and marble stones with concave-convex line drawing patterns can only be done manually by using waterproof abrasive papers repeatedly, so that the production efficiency is low, the processing cost is high, and the product quality is heavily dependent on the experience of an operator and cannot be guaranteed. Furthermore, during manual grinding, dust is be produced, the grinding is labor intensive, and long repeated polishing actions seriously jeopardize the health of a hand polishing worker.

Moreover, only marble stones with single mirror surface flatting effect can be machined by traditional rotation grinding and polishing method. The polished surfaces of marble building materials and artworks appear extremely inferior to rich representations of polished surfaces of building materials of metal, glass, ceramic and other materials.

In order to render better finish to the marble, it is a common practice to add polishing powder or polishing solution later in the mechanical rotation grinding and polishing, while in the renovation of marble stones, for example marble walls and grounds, marble crystal face polishing agent is mainly used. The polishing efficiency and polishing effect may be improved by using the polishing agent. Recognized principles thereof are that physical and chemical reactions are allowed to take place between nanometer particles in the polishing solution and the surface of the marble stone so as to fill micropores in the surface of the marble, thereby making the surface of the marble smooth and clean. While in the rotation grinding and polishing of the marble stone, the grinding force is relatively high, resulting in a large waste of polishing agent added. Only a small part of the polishing agent acts, thus a large amount of polishing agent is needed.

Vibration polishing is now mainly applied to products with high hardness, for example moulds and jewelry jades and the like, and has an excellent polishing effect. But, for soft materials with loose texture such as marbles, after vibration polishing, stone powder may constantly fall off from the surface of the marble. Not only is the surface not glossy, but also the surface will be deformed by grinding or will be full of small pits and concave texture, causing a feeling of staleness and mattness.

SUMMARY OF THE INVENTION

The present invention aims to provide a new method for mechanically polishing special-shaped faces of marble.

The technical scheme adopted by the present invention is as follows.

A method for polishing special-shaped faces of marble, comprising the following steps: (1) coarse grinding: placing a marble blank into a vibration grinding machine, adding a coarse abrasive material adding water to make the coarse abrasive material pasty, and then conducting vibration grinding until the surface becomes smooth and matte, to obtain a coarsely-ground stone piece; (2) accurate grinding and polishing: taking out the coarsely-ground stone piece and placing it into the vibration grinding machine after the coarse abrasive material remained on the surface is removed, adding an accurate abrasive material and the marble crystal face polishing agent, adding water to make the accurate abrasive material pasty, and conducting accurate vibration grinding continuously until the surface becomes bright; and (3) taking out the stone subjected to accurate grinding and polishing, and removing the surface residues to obtain a polished stone.

The marble may be natural or artificial.

Preferably, the marble crystal face polishing agent contains nanoscale silicate and/or metasilicate.

The marble crystal face polishing agent is used in an amount of 0.3 to 0.7 kg per square meter of marble.

Preferably, the abrasive material is formed by mixing abrasive particle and abrasive powder of different mesh.

The hardness of the abrasive powder in the abrasive particle is not lower than that of the marble.

The abrasive powder in the abrasive particle or the abrasive powder is preferably selected from quartz, corundum, chromium oxide, silicon carbide, alumina porcelain, high-frequency porcelain, silicon carbide, boron carbide, boron nitride, titanium carbide, garnet and perlite.

Preferably, the granularity of the abrasive powder is of 80 to 4000 meshes.

Preferably, the size of the abrasive particle is 2 mm*2 mm to 50 mm*50 mm, or Φ 2 to Φ 50.

The abrasive particle preferably has the shape of a tower, a ball, a cone, a cylinder, an oblique cylinder, a triangle and an oblique triangle.

The beneficial effects of the present invention are described as follows.

With the method of the present invention, the mechanical polishing of special-shaped marble stones is realized, the polishing efficiency is significantly improved, and the polishing cost is greatly lowered. With the polishing cost being only one several tenths that of the present conventional manual method, the cost of a special-shaped marble stone product may be substantially lowered, allowing the special-shaped polished marble stone product to possibly become a widespread building material. Besides, the development and design of the special-shaped marble product are greatly promoted, thereby enriching the "point" and "line" representation of building and decoration marble stones.

With the method of the present invention, the surface and peripheral sections of the marble stone may be polished at the same time. Meanwhile, edges and corners of the sections may be polished to small round corners, thereby overcoming the roughness of the sections and cut corners of the staggeredly arranged stones of products such as a mosaic, a background wall, a border line and the like owing to the modeling and design requirements.

The surface of the marble stone polished and obtained through the method of the present invention may have the lustre of silk, and the visual effect is gentle and natural. Besides, the surface hardness and moistness of the marble as well as the waterproof and antifouling performance may be improved.

The grinding pressure of the method of the present invention is not large, so that the polishing is uneven. A blank with specific concave-convex texture may be machined by machines provided with a gong wheel and the like and polished by the method of the present invention to obtain marble stones with more surface artistic visual effects such as wire drawing light effect, uniform and undulating microwave light effect, spiral light effect of rotational concave-convex texture, spherulite light effect of micro concave-convex round spots, thereby breaking the drawback that the present polished marble stone is single in visual effect.

The method of the present invention may further be applied to the machining of home accessories, small marble accessories and may be used to develop new marble products such as handles of furniture, buttons of suitcases and garment, etc.

With the method of the present invention, the marble stone of medium of higher hardness may be polished to a surface finish of above 75 degrees. After waxing and filling the micropores in the surface of the marble stone, the finish may further be increased to above 85 degrees.

Figure 1:
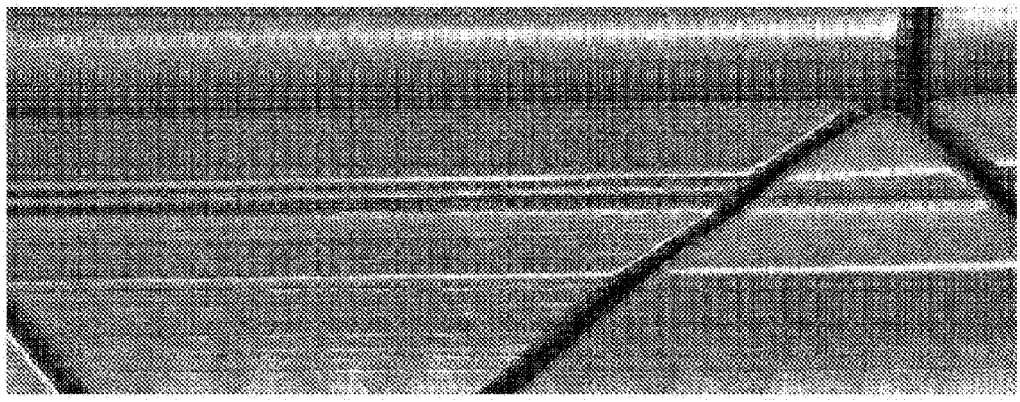
FIG. 1 is an effect graph of a marble polished and obtained through the method of the present invention method.

The present invention will be described with reference to drawings and embodiments.

DETAILED DESCRIPTION OF THE PREFERRED EMBODIMENT

A method for polishing special-shaped faces of marble, comprising the following steps: (1) coarse grinding: placing a marble blank into a vibration grinding machine, adding a coarse abrasive material, adding water to make the coarse abrasive material pasty, and then conducting vibration grinding until the surface becomes smooth and matte, to obtain a coarsely-ground stone piece; (2) accurate grinding and polishing: taking out the coarsely-ground stone piece and placing it into the vibration grinding machine after the coarse abrasive material remained on the surface is removed, adding an accurate abrasive material and the marble crystal face polishing agent, adding water to make the accurate abrasive material pasty, and conducting accurate vibration grinding continuously until the surface becomes bright; and (3) taking out the stone subjected to accurate grinding and polishing, and removing the surface residues to obtain a polished stone.

The marble may be natural or artificial.

The marble polishing agent is mainly used for closing the micropores in the surface of the marble. To obtain good representation after polishing, the polishing agent is preferably transparent. In order to show the true color of the marble, the polishing agent is preferably colorless and transparent. Preferably, the marble crystal face polishing agent is one agent containing nanoscale silicate and/or metasilicate, such as the commonly-used marble crystal face polishing agent in the industry, or a concrete (sealing) curing agent containing silicate, etc.

The polishing agent added in the process of accurate grinding and polishing may be used for 3 to 4 times. After the first use, only a small amount of marble crystal face polishing agent is needed in be added, and then the accurate grinding and polishing may be conducted again. On average, the marble crystal face polishing agent is used in an amount of 0.3 to 0.7 kg per square meter of marble.

Preferably, the abrasive material is formed by mixing abrasive particle and abrasive powder of different mesh.

The abrasive powder has a hardness that is not lower than that of the marble and may be selected from quartz, corundum, chromium oxide, silicon carbide, alumina porcelain, high-frequency porcelain, silicon carbide, boron carbide, boron nitride, titanium carbide, garnet, perlite, etc.

The abrasive particle is formed through binding and pelletizing by a binder, for example plastic, etc. The abrasive particle may have the shape of a tower, a ball, a cone, a cylinder, an oblique cylinder, a triangle, an oblique triangle or have other special shapes. Large abrasive particle may effectively isolate stone pieces and prevent the creation of small pits or fragmentation of the stone pieces resulted from mutual collision of the stone pieces. The large abrasive particle is high in grinding efficiency, and the abrasive powder contained in the abrasive particle is high in the mesh, thereby allowing the surface of the stone piece to be more fine and smooth, but small slits cannot be ground. While small abrasive particle is used for grinding at small grooves and corners of the stone piece, within the limited distance of vibration grinding, but the overall grinding efficiency is relatively low. Abrasive powder with low mesh may be selected to compensate for the relatively low grinding efficiency. The abrasive powder is mixed with water to produce a paste to cover the stone piece, and the abrasive particle forces the abrasive powder to conduct grinding, thereby further improving the grinding effect. The requirement for grinding different kinds of marble pieces may be met by mixing abrasive powders having different mesh. Giving consideration to both the grinding efficiency and the grinding effect, the abrasive particle and the abrasive powder of different materials, mesh, shapes and specifications are mixed to obtain the abrasive material.

Preferably, the granularity of the abrasive powder is of 80-4000 mesh.

Preferably, the size of the abrasive particle is 2 mm*2 mm to 50 mm*50 mm, or Φ 2 to Φ 50.

The present invention will be further illustrated in connection with the embodiments.

Embodiment 1

(1) coarse grinding: a marble blank piece of 2 to 4 m2 is placed into the vibration grinding machine according to the shape, size and thickness thereof at room temperature; 130 kg of oblique triangular alumina porcelain abrasive particle of 6 mm*6 mm the abrasive powder thereof is of 400 mesh), 70 kg of alumina porcelain ball abrasive particle with the Φ=10 mm (the abrasive powder is of 400 mesh), 5 kg of 160-mesh quartz sand and 2 kg of 600-mesh quartz sand are added; water is added to make the coarse abrasive material pasty; and the marble blank piece is subjected to vibration grinding for 4 to 10 hours according to the kind, degree of hardness and depth of mechanical scorings to remove rough mechanical scorings such as sharp corners, saw notches and gong notches and the like until the stone surface becomes smooth and matte, thereby obtaining a coarsely-ground stone piece; (2) accurate grinding and polishing: the coarsely-ground stone piece is took out and washed by water to remove the residual abrasive material and stone powder; the coarsely-ground stone piece after cleaning is placed into a vibration grinding machine of the same specification; an accurate abrasive material is added, and then water is added to make the accurate abrasive material pasty; and the surface of the stone is subjected to accurate vibration grinding until it becomes glossy, wherein the accurate abrasive material consists of 120 kg of 6 mm*6 mm tapered plastic abrasive particle (the abrasive powder thereof is of 400 mesh), 80 kg of 10 mm*10 mm tapered plastic abrasive grain (the abrasive powder thereof is of 600 mesh) and 3.5 kg of marble crystal face polishing agent; and the surface of the stone is subjected to vibratory polishing for 9 to 13 hours until the surface becomes bright; and (3) taking out the accurate ground stone and grinding off surface residues gently by a wool wheel to obtain a polished stone.

Wherein the vibration grinding machine has a vibration frequency of 1500 Hz, an amplitude of 3 to 6 mm, a volume of 400 L; the marble crystal face polishing agent is a mixture of nanometer silicates and contains cerium oxide-based composite polishing powder; and the marble blank piece is 8 to 18 mm in thickness, and the surface pattern is 1 to 10 mm in thickness.

Upon testing, the marble of medium or higher hardness has a surface finish up to 70 to 75 degrees after polishing, and the average hardness of surface layer is also increased. The stone after polishing is shown in FIG. 1. As can be seen from FIG. 1, the surface of the stone is smooth with all sharp corners becoming smooth small round corners, and the texture is more moist than that of the stone polished by the traditional rotation grinding and polishing method. Loose places on the surface give an antique impression. The stone exhibits a soft silk light as a whole and is crystal clear.

Embodiment 2

(1) A marble blank piece of wire drawing light, a blank piece of spiral light, a blank piece of microwave light and a blank piece of spherulite light, which are 3 m2 totally, are placed into the vibration grinding machine; 120 kg of 4 mm*4 mm tapered plastic abrasive grain (the abrasive powder thereof is of 400 mesh), 80 kg of 10 mm*10 mm tapered plastic abrasive grant (the abrasive powder is of 600 mesh), 5 kg of 600-mesh quartz sand and 2 kg of 160-mesh quartz sand are added; water is added to make the coarse abrasive material pasty; the vertical amplitude, the horizontal amplitude and vibration frequency of the grinding machine are adjusted to 5 mm, 2 mm and 1500 Hz respectively; the grinding machine is started to conduct grinding for 3 to 10 hours until the surface of the marble blank piece not only reserves the concave-convex texture pattern, but also is fine and smooth, thereby obtaining a coarsely-ground piece; (2) accurate grinding and polishing: the coarsely-ground stone piece is took out, washed clean by water and then placed into a vibration grinding machine having the same settings; 4 kg of marble crystal face polishing agent containing nanometer silicate mixture of 5% cerium oxide-based composite polishing powder, 120 kg of 4 mm*4 mm tapered plastic abrasive grain (the abrasive powder thereof is of 600 mesh), 80 kg of 10 mm*10 mm tapered plastic abrasive grain (the abrasive powder thereof is of 600 mesh) are added; water is added to make the accurate abrasive material pasty; and vibration grinding is performed for 3 to 12 hours; and (3) taking out the marble piece and grinding off residues on the surface of the stone gently by a wool wheel to obtain a polished stone.

Upon testing, the marble of medium or higher hardness has a surface finish up to 70 to 75 degrees after polishing, and the average surface layer hardness is also increased. The polished stone has clear wire drawing light effect, spiral light effect, microwave light effect and spherulite light effect, exhibits a soft silk light as a whole and is crystal clear.

FIG. 1 is an effect graph of a marble polished and obtained through the method of the present invention method. As can be seen, the surface of the marble polished has soft lustre and rounded corners, and the polished marble exhibits a soft silk light as a whole and is crystal clear.

Figure 2:
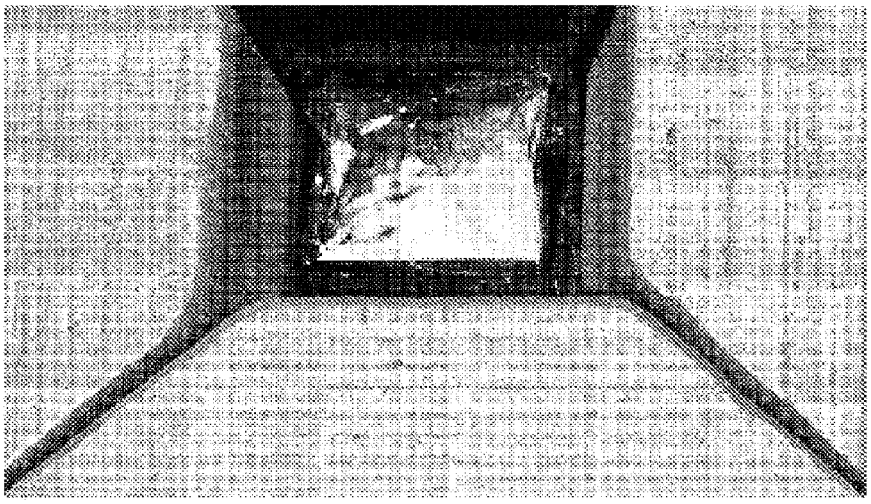
FIGS. 2 and 3 are effect graphs of microwave light obtained through the method of the present invention.
Figure 3:
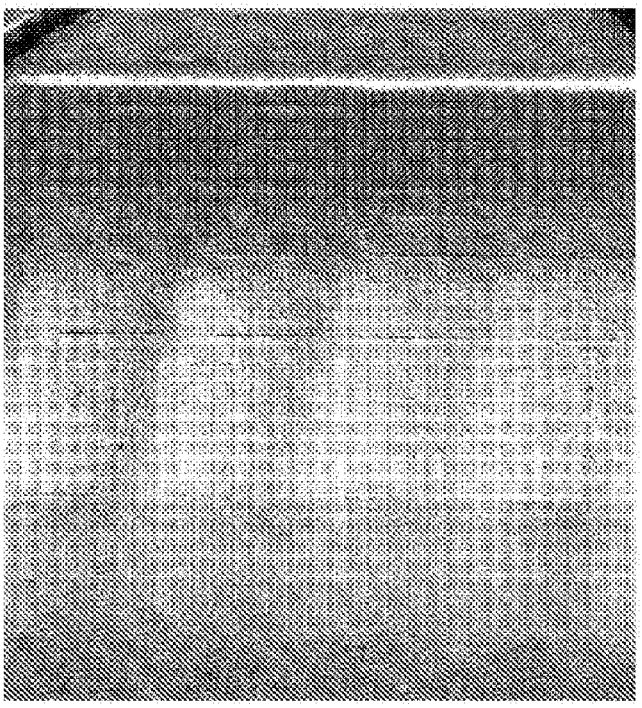

FIGS. 2 and 3 are effect graphs of microwave light obtained by the method of the present invention. As can be seen, the polished marble has the effect of uniform and undulating microwave lines, reflecting soft wave light.

Figure 4:
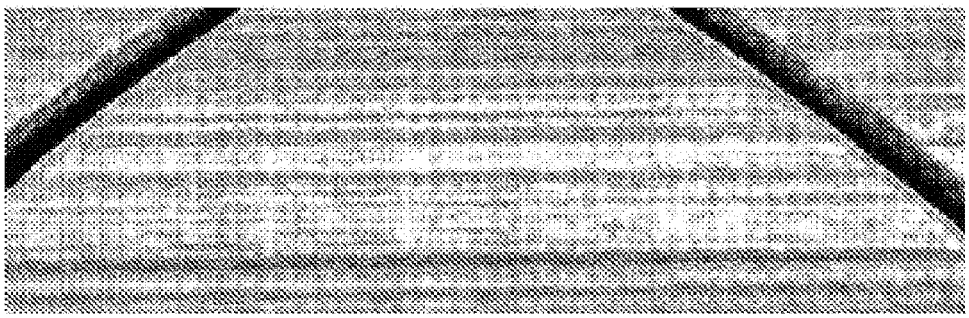
FIG. 4 is an effect graph of wire drawing light obtained through the method of the present invention.

FIG. 4 is an effect graph of wire drawing light obtained by the method of the present invention. As can be seen, the polished marble has smooth surface and the metal wire drawing effect, and such polished marbles give unique aesthetics when spliced together.

Figure 5:
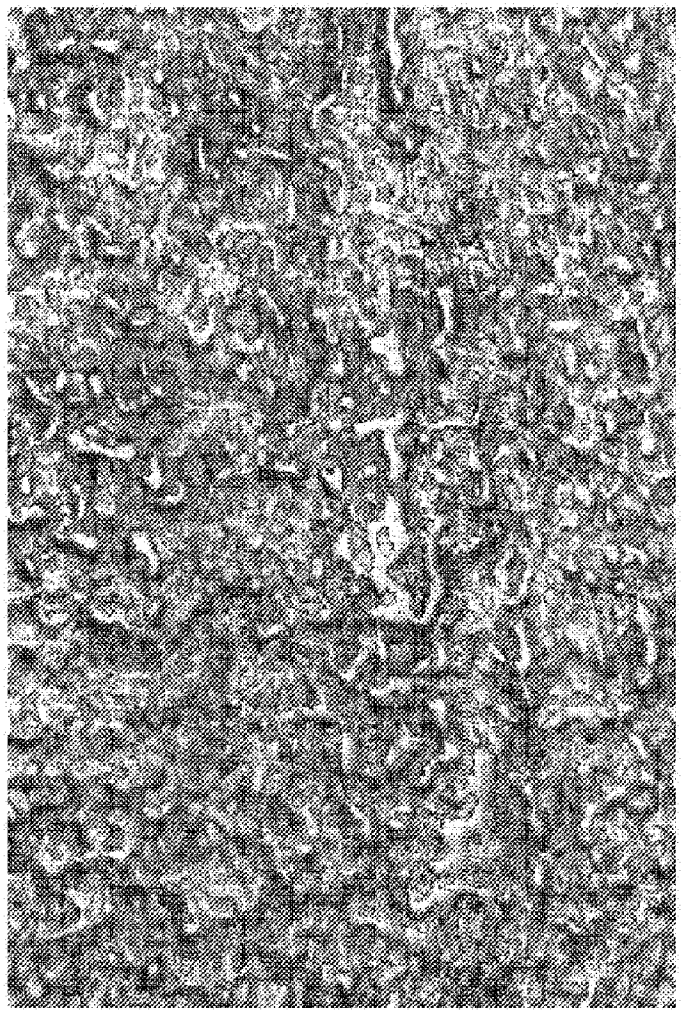
FIG. 5 is an effect graph of spherulite light obtained through the method of the present invention.

FIG. 5 is an effect graph of spherulite light obtained by the method of the present invention, showing the effect of twinkling spherulite light.

The embodiments of the invention in which an exclusive property or privilege is claimed are defined as follows:

1. A method for polishing special-shaped faces of marble, comprising the following steps:

1) coarse grinding: placing a marble blank into a vibration grinding machine, adding a coarse abrasive material, adding water to make the coarse abrasive material pasty, and then conducting vibration grinding until the surface becomes smooth and matte, to obtain a coarsely-ground stone piece;
2) accurate grinding and polishing: taking out the coarsely-ground stone piece and placing it into the vibration grinding machine after the coarse abrasive material remained on the surface is removed, adding an accurate abrasive material and a marble crystal face polishing agent, adding water to make the accurate abrasive material pasty, and conducting accurate vibration grinding continuously until the surface becomes bright; and
3) taking out the stone subjected to accurate grinding and polishing and removing the surface residues to obtain a polished stone.

2. The method of claim 1, wherein the marble is natural or artificial.

3. The method of claim 1, wherein the marble crystal face polishing agent contains at least one of nanoscale silicate or metasilicate components.

4. The method of claim 1, wherein the marble crystal face polishing agent is used in an amount of 0.3-0.7 kg per square meter of marble.

5. The method of claim 1, wherein the coarse abrasive material and the accurate abrasive material is formed by mixing abrasive particle and abrasive powder of different mesh.

6. The method of claim 5, wherein the hardness of the abrasive powder in the abrasive particle is not lower than that of the marble.

7. The method of claim 6, wherein the abrasive powder in the abrasive particle is selected from the group comprising quartz, corundum, chromium oxide, silicon carbide, alumina porcelain, high-frequency porcelain, silicon carbide, boron carbide, boron nitride, titanium carbide, garnet and perlite.

8. The method of claim 5, wherein the granularity of the abrasive powder in the abrasive particle is between 80 and 4000 meshes.

9. The method of claim 5, wherein the size of the abrasive particle is 2 mm*2 mm to 50 mm*50 mm, or ϕ 2 to ϕ 50.

10. The method of claim 5, wherein the abrasive particle has the shape of one of a tower, a ball, a cone, a cylinder, an oblique cylinder, a triangle and an oblique triangle.

11. The method of claim 2, wherein the marble crystal face polishing agent contains at least one of nanoscale silicate or metasilicate components.

12. The method of claim 2, wherein the marble crystal face polishing agent is used in an amount of 0.3-0.7 kg per square meter of marble.

13. The method of claim 6, wherein the granularity of the abrasive powder in the abrasive particle is between 80 and 4000 meshes.

14. The method of claim 7, wherein the granularity of the abrasive powder in the abrasive particle is between 80 and 4000 meshes.

15. The method of claim 6, wherein that the abrasive particle has the shape of one of a tower, a ball, a cone, a cylinder, an oblique cylinder, a triangle and an oblique triangle.

16. The method of claim 7, wherein that the abrasive particle has the shape of one of a tower, a ball, a cone, a cylinder, an oblique cylinder, a triangle and an oblique triangle.

17. The method of claim 9, wherein that the abrasive particle has the shape of one of a tower, a ball, a cone, a cylinder, an oblique cylinder, a triangle and an oblique triangle.

* * * * *